United States Patent [19]

Ogawa

[11] Patent Number: 4,748,779

[45] Date of Patent: Jun. 7, 1988

[54] TELESCOPIC ARM FOR USE IN CIVIL ENGINEERING MACHINES

[76] Inventor: Junji Ogawa, 10033-1, Gomi, Kiga, Hosoe-cho, Inasa-gun, Shizuoka-ken, Japan

[21] Appl. No.: 919,524

[22] Filed: Oct. 16, 1986

[51] Int. Cl.[4] ..... E04H 12/18; B66C 23/00

[52] U.S. Cl. ..... 52/118; 52/632; 212/269

[58] Field of Search ..... 52/115, 118, 632; 212/267, 269

[56] References Cited

U.S. PATENT DOCUMENTS

| | | | |
|---|---|---|---|
| 2,993,570 | 7/1961 | Bender | 52/118 |
| 3,874,136 | 4/1975 | Michel | 52/118 |
| 4,036,372 | 7/1977 | Rao et al. | 52/118 |
| 4,045,936 | 9/1977 | Sterner | 52/118 |
| 4,100,707 | 7/1978 | Kranefeld et al. | 52/118 |
| 4,168,008 | 9/1979 | Granryd | 52/118 |
| 4,272,932 | 6/1981 | Wappler | 52/118 |
| 4,699,562 | 10/1987 | Crook et al. | 212/269 |

FOREIGN PATENT DOCUMENTS

| | | | |
|---|---|---|---|
| 2002090 | 1/1970 | Fed. Rep. of Germany | 212/269 |

OTHER PUBLICATIONS

Product Brochure Cover, Yutani-Kobelco Slide Arm Drawing.

*Primary Examiner*—David A. Scherbel
*Assistant Examiner*—Caroline D. Dennison
*Attorney, Agent, or Firm*—Armstrong, Nikaido, Marmelstein & Kubovcik

[57] ABSTRACT

A telescopic arm for use in civil engineering machines, in which guide rails extended axially are disposed while being protruded outwardly on both lateral sides of a base arm which is pivoted to the boom of a civil engineering machine main body, guide grooves each concaved inwardly in a U-cross sectional shape are formed axially on both lateral sides of the slide arm which moves along the axial direction of the base arm, slide blocks disposed on both lateral sides at the forward end of the base arm are in a slidable fitting engagement into the guide grooves of the slide arm, while slide blocks of a U-cross sectioned concaved shaped disposed on both lateral sides at the rearward end of the slide arm are in a slidable fitting engagement with the rails of the base arm.

3 Claims, 2 Drawing Sheets

TELESCOPIC ARM FOR USE IN CIVIL ENGINEERING MACHINES

BACKGROUND OF THE INVENTION

1. Field of the Invention

This invention concerns an improvement in a telescopic arm comprising a slide arm engaged slidably with a base arm which is pivoted to a boom or the like on the main body of a civil engineering machine and, more particularly, it relates to a telescopic arm in which the slide arm and the base arm are caused to slide with each other in a plane-to-plane engagement and the portion for the sliding engagement situated near the forward end that is put under the effect of earth and sand is formed at an inner position from the surface on the side of the slide arm.

2. Description of the Prior Art

As a device for varying and widening the working range of an operation arm attached to a civil engineering machine such as an excavator, there has been known an assembly referred to as a telescopic arm. In the telescopic arm, a base arm connected to the top end of the boom of the machine and a slide arm are slidably engaged with each other by means of guide plates disposed at the lower surface of the base arm and at the upper surface of a slide arm on both ends respectively such that the guide plates of the slide arm are held between upper and lower rollers attached at the forward end of the base arm, while the guide plates of the base arm are held between upper and lower rollers attached at the rearward end of the slide arm.

However, since the working loads upon excavation are exerted on the pins for the rollers, the loads are concentrated to the pins thereby resulting in problems in view of the strength that they are readily deformed or flexed.

Further, since the telescopic arm of this type is extended or contracted by the rolling of the rollers along the guide rails exposed to the outside, earth and sand or concrete lump deposited on the rail surface may possibly get into the rollers thereby also causing deformation and flexure in the roller shafts. Further, the axes for the entire arm tends to be distorted to hinder the smooth telescopic operation.

Particularly, since the rails of the slide arm at the forward portion are protruded outwardly, they are readily deformed by external objects. In addition, even if the deformation is resulted only locally, since the rollers rotate in point-to-point contact with the deformed surface, undesired effects are also caused to other members such as wearing or localized abrasion of the rollers, thereby making the maintenance work extremely difficult.

OBJECT OF THE INVENTION

Accordingly, it is a first object of this invention to provide a telescopic arm capable of avoiding deformation or damage in the engaging members between a base arm and a slide arm and capable of withstanding great loads upon excavating work.

Another object of this invention to ensure smooth telescopic operation by protecting the surface for slidable engagement between the base arm and the slide arm against the effect of earth and sand.

A further object of this invention is to facilitate the maintenance work against the abrasion in the slidable engaging portion.

SUMMARY OF THE INVENTION

The foregoing objects of this invention can be attained by a telescopic arm for use in civil engineering machines, in which a slide arm is engaged slidably to a base arm to be pivoted to the top end of a boom or the like, and the slide arm is caused to slide in a telescopic manner along the base arm by driving means such as a hydraulic cylinder disposed between both of the arms, wherein the telescopic arm comprises:

- a base arm having axially extended guide rails formed on both lateral sides thereof while being protruded outwardly,
- a slide arm having axially extended guide grooves formed on both lateral sides thereof and concaved inwardly in a U-cross sectioned shape,
- a bracket attached to each of the lateral sides of the base arm near the forward end thereof and integrally formed with a slide block for slidable fitting engagement into the guide groove formed to the slide arm, and
- a bracket attached near the rearward portion of the slide arm and integrally formed with a slide block of a U-shaped sectioned concaved shape for slidable fitting engagement with the guide rail of the base arm, whereby
- the guide groove in the U-cross sectioned shape of the slide arm is engaged in a plane-to-plane engagement with the hook-like block of the base arm at a position inner from the surface on the side of the slide arm, and the rail of the base arm is engaged also in a plane-to-plane engagement into the U-cross sectioned recess in the slide block of the slide arm.

In a preferred embodiment of this invention, shims are detachably mounted to the sliding faces of the respective slide blocks and wipers are secured on both ends of the slide blocks for protecting them.

BRIEF DESCRIPTION OF THE ACCOMPANYING DRAWINGS

This invention will now be described by way of preferred embodiments while referring to the accompanying drawings, wherein.

DETAILED DESCRIPTION OF THE PREFERRED EMBODIMENT

Figure 1:
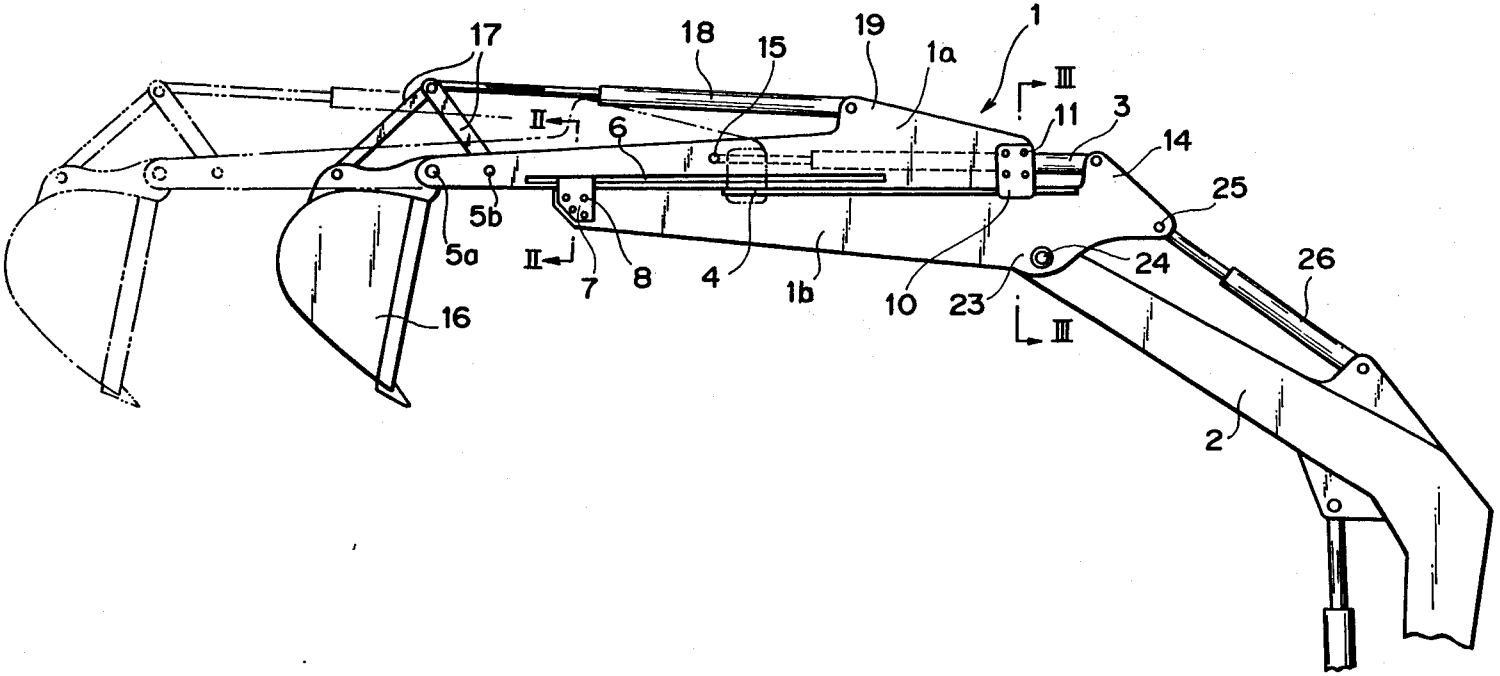
FIG. 1 is a side elevational view of a telescopic arm according to this invention.

As shown in FIG. 1, telescopic arm 1 comprises base arm 1*b* connected to the top end of a boom secured to the main body of a civil engineering machine, slide arm is slidably engaged to the base arm 1*b* from above and along with the axial direction thereof, and driving means such as a hydraulic cylinder 3 disposed between the base arm 1*b* and the slide arm 1*a* for reciprocating the slide arm 1*a* along the base arm 1*b*, etc.

A pair of guide rails 4 are extended along the upper edges on both lateral sides of the base arm 1*b* from rearward to forward while being projected outwardly. A pair of guide grooves 6 are formed on both lateral sides of the slide arm 1*a* while being concaved inwardly from the vicinity of attachment mounting holes 5*a* and 5*b* at the top end toward the rearward end in parallel with the lower surface of the arm 1*a*. The guide groove 6 is preferably formed in a U-cross sectioned shape as shown in FIG. 2 in view of the strength.

These guide rails 4 and the guide grooves 6 have appropriate length and are disposed at appropriate positions depending on the desired extending and contracting stroke of the telescopic arm 1.

Figure 2:
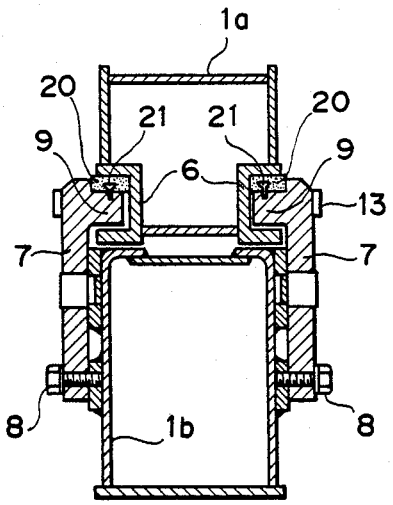
FIG. 2 is a cross sectional view taken along line II—II in FIG. 1.

As shown in FIG. 2, vertically extended brackets 7 and 7 are detachably mounted on both lateral sides at the forward portion of the base arm 1*b*, desirably, by means of four bolts 8. Each of the brackets 7 has an integral slide block 9 protruded inwardly in a hooked-shape for engagement with the guide groove 6 of the slide arm 1*a*.

Figure 3:
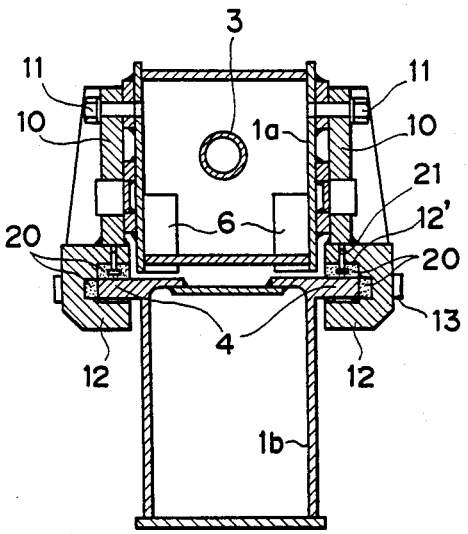
FIG. 3 is a cross sectional view taken along line III—III in FIG. 1.

As shown in FIG. 3, downwardly extended brackets 10 and 10 are detachably mounted on both lateral sides at the rearward portion of the slide arm 1*a*, desirable, by means of four bolts 11. Each of the brackets 10 and 10 has, on its inside, an integral slide block 12 of a U-cross sectioned shape having a lateral groove 12' for slidable fitting engagement with the guide rail 4 of the base arm 1*b* (fitting engagement means herein the plane-to-plane engagement between protruded and concaved portions) opposed to each other.

A grease oil supply 13 is disposed to the slide blocks 9 and 12 for supplying lubricating grease to the sliding face by way of a grease port (not illustrated) formed in the thick walled portion of the blocks.

In this way, the slide arm 1*a* is slidably supported on the base arm 1*b* by the fitting engagement of the slide block 9 protruded at the forward portion of the base arm 1*b* into the guide groove 6 recessed at a position inner from the surface on the side of the slide arm 1*a*, as well as by the fitting engagement of the guide rail 4 of the base arm 1*b* into the lateral groove 12' of the U-cross sectioned slide block 12 disposed at the rearward portion of the slide arm 1*a*.

Driving means such as a hydraulic cylinder 3 is pivoted at one end thereof to bracket 14 disposed at the upper rearward portion of the base arm 1*b*. The hydraulic cylinder 3 is disposed through the inside of the slide arm 1*a* and pivoted at the other end thereof to pin 15 attached between the side plates of the slide arm 1*a*.

In the drawings, are also shown operating attachment 16 such as a bucket connected with mounting holes 5*a* and 5*b* at the forward end of the slide arm 1*a*, link machanism 17, and hydraulic cylinder 18 for operation mounted between upper bracket 19 of the slide arm 1*a* and the actuating link mechanism 17 for the attachment.

In a more preferred embodiment as shown in FIGS. 2 and 3, shims 20 are attached at the sliding contact face of the slide blocks 9 and 12 with the mating members for making the sliding movement smooth between the base arm 1*b* and the slide arm 1*a*, as well as reducing the abrasion at the sliding contact face between the slide blocks 9 and 12, thereby facilitating the maintenance work.

That is, as shown in FIG. 2, the shims 20 are detachably mounted by means of bolts 21 to the slide block 9 of the base arm 1*b* at the abutting surface with the U-cross sectioned guide groove 6 of the slide arm 1*a*. The shim 20 is protruded slightly to the inner side than the top end of the slide block 9 so that the inner side, as well as the upper and lower sliding faces of the block 9 can be protected together by the common shim 20.

In the same manner, as shown in FIG. 3, the shims 20 are also mounted detachably by means of bolt 21 to the upper surface and the inner side surface of the U-cross sectioned slide block 13 attached to the slide arm 1*a*, that is, at the abutting face against the guide rails 4 of the base arm 1*b*.

The shim 20 is preferably made of material with low friction coefficient such as rigid plastics (hard nylon).

Figure 4:
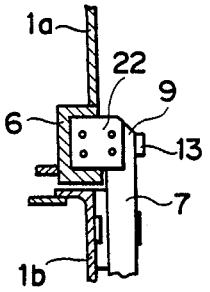
FIG. 4 is a fragmentary side elevational view for the telescopic arm shown in FIG. 4.
Figure 5:
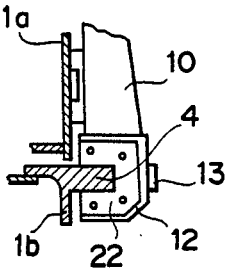
FIG. 5 is a fragmentary side elevational view for the telescopic arm shown in FIG. 3.

As shown in FIGS. 4 and 5, wipers 22 are detachably mounted by means of bolts 23 on both forward and rearward ends of the slide blocks 9 and 13 respectively for removing earth and sand deposited on the sliding face of the guide groove 6 and the guide rail 4 of the mating sliding member and for protecting the slide blocks 9 and 12 and the shims 20. These wipers 22 are usually made of flexible material such as rubber.

The telescopic arm according to this invention is usually used by pivoting the top end of the boom 2 of the civil engineering machine main body into the pin hole 24 of bracket 23 disposed at the lower rearward portion of the base arm 1*b* and connecting one end of arm rotating cylinder 26 into pin hole 25 at the rearward end of the base arm 1*b*. Upon actuating the telescopic arm, the working position for the operation attachment 16 is optionally selected within the range of the extensible stroke of the telescopic arm 1 by telescopically adjusting the slide arm 1*a* along the base arm 1*b* by the hydraulic cylinder 3.

In the telescopic arm according to this invention, since the base arm and the slide arm are abutted to engage with each other along flat faces, the pressure of plane per unit area is decreased and, accordingly, the arm can bear greater loads. In addition since earth and sand in the guide grooves and on the surface of the guide rails can be removed upon sliding movement, intrusion of earth and sand into the sliding face can be avoided.

Particularly, since the engaging portion between the slide block of the base arm and the slide arm is situated at a position inner from the surface on the side of the arm, if earth and sand should scatter over the forward portion of the arm during excavating operation, there is no worry that the earth and sand are intruded to damage the sliding face.

Further in the modified embodiment in which the shims are detachably disposed to the sliding face of the slide blocks, since the maintenance work for abrasion can be conducted merely by replacing the shims without detaching but using the slide blocks as they are, much economical advantage can be obtained as compared with the conventional case where all of the rollers have to be replaced.

Furthermore, in another modified embodiment in which the wipers are disposed to the slide blocks, since earth and sand in the guide grooves or on the surface of the guide rails can previously be removed, the slide block and, particularly, the shims can be protected to improve the working life.

What is claimed is:

1. A telescopic arm for use in a civil engineering machine, in which a slide arm is engaged slidably to a base arm to be pivoted at the top end of a boom and said slide arm is caused to slide in a telescopic manner along said base arm by driving means such as a hydraulic cylinder disposed between both of said arms, wherein said telescopic arm comprises:

a base arm 1*b* having lateral sides and axially extended guide rails 4 formed on both lateral sides thereof and protruding outwardly;

a slide arm 1*a* having lateral sides and axially extended guide grooves 6 formed on both lateral sides thereof, said grooves being concaved inwardly in a U-cross sectioned shape;

a bracket 7 attached to the forward end of each of the lateral sides of said base arm 1*b* and integrally formed with a slide block 9 for a slidable fitting engagement into the guide groove 6 formed in said slide arm 1*a*; and a bracket 10 attached near the rearward portion of said slide arm 1*a* and integrally formed with a slide block 12 of a U-cross sectioned concaved shape for a slidable fitting engagement with the guide rail 4 of said base arm 1*b*.

2. A telescopic arm as defined in claim 1, wherein shims 20 are detachably mounted at the respective sliding portions between the slide block 9 of the base arm 1*b* and the slide block 12 of the slide arm 1*a*.

3. A telescopic arm as defined in claim 1 or 2, wherein wipers 22 are disposed at the forward and rearward ends of the slide block 9 of the base arm 1*b* and the slide block 12 of the slide arm 1*a*.

* * * * *